US005411413A

United States Patent [19]

Yamamoto

[11] Patent Number: 5,411,413

[45] Date of Patent: May 2, 1995

[54] CONNECTOR

[75] Inventor: Masaya Yamamoto, Shizuoka, Japan

[73] Assignee: Yazaki Corporation, Tokyo, Japan

[21] Appl. No.: 192,814

[22] Filed: Feb. 7, 1994

[30] Foreign Application Priority Data

Feb. 8, 1993 [JP] Japan ..... 5-008271 U

[51] Int. Cl.[6] ..... H01R 13/58

[52] U.S. Cl. ..... 439/470; 439/456; 439/458

[58] Field of Search ..... 439/456–459, 439/470

[56] References Cited

U.S. PATENT DOCUMENTS

| | | | |
|---|---|---|---|
| 3,960,425 | 6/1976 | Kirk et al. | 439/470 X |
| 4,443,051 | 4/1984 | Aguilar | 439/470 |
| 5,006,960 | 4/1991 | Kallin et al. | 439/459 X |

*Primary Examiner*—Eugene F. Desmond
*Attorney, Agent, or Firm*—Sughrue, Mion, Zinn, Macpeak & Seas

[57] ABSTRACT

To assure that there does not arise a malfunction that a cable connected to a crimp terminal is disconnected from a connector housing, and moreover, the cable is electrically incorrectly connected to the crimp terminal crimped on the cable, after the cable is drawn outside of a connector housing, it is once bent in the downward direction while extending through a cable receiving groove formed at one end of a slide housing, and subsequently, the cable is retained by a cable retainer adapted to be inserted into the connector housing on a cable receiving portion. At this time, the cable is retained in a cable retaining groove formed at one end of the cable retainer while extending through a cable extension groove formed at one end of the cable receiving portion. Thus, the cable is firmly held by the cable retainer in the squeezed state in cooperation with the cable receiving portion without any possibility that the cable is disconnected from the connector housing. Alternatively, the cable may include a plurality of slide housings each adapted to be slidably inserted into the connector housing. The slide housings are arranged one above another to provide a multi-stage connector.

7 Claims, 5 Drawing Sheets

CONNECTOR

BACKGROUND OF THE INVENTION

1. Field of the Invention

The present invention relates generally to a multi-stage connector including a plurality of connector housings each having a plurality of crimping terminals received therein wherein a plurality of cables are brought in contact with the corresponding crimping blades held in the crimping terminals while each of the cables is covered with a sheath layer. More particularly, the present invention relates to improvement of a multi-stage connector of the foregoing type wherein a plurality of crimping terminals are arranged in the parallel relationship relative to each other at each stage, and moreover, a plurality of crimping terminals received at all the stages are located in alignment with each other in the vertical direction.

2. Description of the Related Art

In recent years, various kinds of connectors are practically used in many industrial fields for the purpose of electrically connecting cables to another cables or terminals in an electric equipment, an electronized vehicle or the like. Generally, each connector is constructed such that each terminal having a cable connected thereto is received in a connector housing. Otherwise, each connector is constructed such that a cable is electrically connected to another cable not via soldering or crimping but via pressure-contacting.

To facilitate understanding of the present invention, a typical conventional multi-stage connector of the foregoing type will be described below with reference to FIG. 7 to FIG. 9.

In the drawings, reference numeral 1 designates a connector housing. A plurality of terminal receiving chambers 2 are formed at the upper stage of the connector housing 1, and the front end wall of each terminal receiving chamber 2 and a part of the upper wall of the same in the vicinity of the foremost end of the connector housing 1 are cut out so as to form an opening portion 3. A crimp terminal 19 to be described later with reference to FIG. 8 is inserted into the corresponding terminal receiving chamber 2 through the opening portion 3, and thereafter, a cable to be described later is likewise inserted into the corresponding terminal receiving chamber 2 through the opening portion 3 by actuating an automatic feeding unit (not shown) so as to enable the terminal 19 to be crimped on the cable. Reference numerals 4 and 5 designate slide housings (male connector housings), respectively. The slide housings 4 and 5 are slidably inserted into the connector housing 1 not only at the middle stage but also as the lower stage of the same.

A fixing protuberance 6 and an engagement protuberance 7 are disposed on each side wall of the slide housings 4 and 5 while projecting outside of the side wall. To cooperate with the fixing protuberance 6 and the engagement protuberance 7, provisional engagement windows 8 and normal engagement windows 9 are formed through each side wall of the connector housing 1 while they are located in alignment with each other in the A arrow-marked direction.

Reference numeral **6*a* designates a fixing protuberance disposed on each side wall of the connector housing 1. With this construction, when the slide housings 4 and 5 are inserted into the connector housing 1, the fixing protuberances 6*a* and 6** are located in alignment with each other in the vertical direction.

Reference numeral 12 designates a housing cover. A plurality of fixing/engaging windows 13 are formed through the housing cover 12. When the fixing protuberances **6*a* and 6 are engaged with the fixing/engagement windows 13, the opening portion 3 of the connector housing 1 is closed with an upper wall 14 of the housing cover 12**.

Next, an assembling operation to be performed for the conventional multi-stage connector constructed in the aforementioned manner will be described below.

While the slide housing 5 located at the lower stage is held in the provisionally engaged state (wherein the engagement protuberances 7 are engaged with the provisional engagement windows 8), a cable 15 is inserted into the opponent terminal 19 which in turn is crimped on the cable 15 from above by actuating an automatic feeding unit (not shown), causing the cable 15 to be electrically connected to the crimp terminal 16 via the terminal 16. Subsequently, the slide housing 5 is slidably squeezed in the connector housing 1 until the engagement protuberances 7 are engaged with the normal engagement windows 9.

Next, the slide housing 4 located at the middle stage is held in the provisionally engaged state (wherein the engagement protuberances 7 are engaged with the provisional engagement windows 8), and subsequently, a cable 15 is brought in contact with a terminal 16 from above by actuating the automatic feeding unit (not shown) so as to allow the terminal 16 to be crimped on the cable 15 for making electrical connection therebetween. Thereafter, the slide housing 4 is slidably squeezed in the connector housing 1 so that the engagement protuberances 7 on the slide housing 5 are engaged with the normal engagement window 9. It is obvious that another cable 15 is likewise brought in contact with a terminal 16 received in the receiving chamber 2 of the connector housing 1 from above so as to allow the terminal 16 to be crimped on the cable 15 in the same manner as mentioned above for making electrical connection to a crimp terminal 19 via the thus crimped terminal 16.

A squeezing operation (closing operation) is performed for the slide housings 4 and 5 in the A arrow-marked direction by actuating an automatic squeezing unit (not shown), while a drawing operation is performed for the same in the B arrow-marked direction by actuating the foregoing automatic squeezing unit. In FIG. 8, reference numeral 17 designates a guide wall. The guide wall 17 is constructed such that a male terminal insert hole 18 is formed through the rear wall of each terminal receiving chamber 2 so as to allow a male terminal (not shown) to be fitted thereinto.

As shown in FIG. 9, while the connector housing 1 is assembled with the aforementioned components, the fixing projections **6*a* and 6 are engaged with the engagement windows 13 so as to prevent the slide housings 4 and 5 from being disconnected from the connector housing 1**.

With the conventional multi-stage connector constructed in the above-described manner, since each assembling operation can automatically be performed in that way with the aid of the foregoing automatic units (not shown), it can be achieved at a high efficiency. Another advantageous effect is that the number of crimp terminals to be received in the connector housing in the multi-staged state can arbitrarily be increased.

However, since the conventional multi-stage connector is not provided with any type of cable retaining means, when a certain intensity of mechanical power is applied to the crimped part of the terminal, incorrect electrical contacting is liable to occur with the multi-stage connector. To assure that the multi-stage connector is provided with cable retaining means, it should unavoidably be constructed with larger dimensions because of a necessity for preparing a certain space for receiving the cable retaining means therein.

In addition, in the case that a certain intensity of cable pulling power is exerted on a bundle of cables in such a direction that it is drawn out of the connector housing, since the conventional multi-stage connector does not include any means for standing against the cable pulling power, the intensity of cable holding power exerted on the terminal at the crimped part of the latter is undesirably reduced. Also in this case, a malfunction of incorrect electrical contacting is liable to occur with the multi-stage connector.

SUMMARY OF THE INVENTION

The present invention has been made in consideration of the aforementioned background.

An object of the present invention is to provide a multi-stage connector which assures that there do not arise malfunctions that a cable having a crimp terminal crimped thereon is disconnected from a connector housing, and moreover, the cable is incorrectly electrically connected to the crimp terminal crimped thereon.

Another object of the present invention is to provide a multi-stage connector of the foregoing type which assures that physical properties of the multi-stage connector in respect of shock resistance especially at the crimped part of the crimp terminal can be improved.

According to one aspect of the present invention, there is provided a connector wherein a slide housing having a crimp terminal received therein is slidably received in a connector housing, the crimp terminal being crimped on a cable so as to be electrically connected to the crimp terminal, and the cable having the crimp terminal crimped thereon is drawn out of the slide housing, wherein the connector comprises a cable receiving groove formed at one end of the slide housing from which the cable is drawn out, a cable receiving portion disposed along the bottom wall of the connector housing in operative association with the cable receiving groove of the slide housing, a cable extension groove formed on the cable receiving portion at the position located in alignment with the cable receiving groove of the slide housing, and a cable retainer adapted to be inserted into the connector housing on the cable receiving portion, the cable retainer serving to firmly hold the cable drawn outside of the connector housing in the squeezed state in cooperation with the cable receiving groove of the slide housing and extending through the cable extension groove of the cable receiving portion in a predetermined direction.

Normally, the cable retainer is designed in the form of an elongated plate.

To assure that the cable is firmly held by the cable retainer in the squeezed state, it is desirable that a cable retaining groove is formed at one end of the cable retainer at the position located in alignment with cable receiving groove of the slide housing and the cable extension groove of the cable receiving portion.

To allow the cable retainer to be reliably fitted to the connector housing in the engaged state, engagement protuberances are disposed on the opposite side walls of the cable retainer while projecting outside of the same.

To cooperate the cable retainer with the connector housing, engagement holes are formed through the opposite side walls of the connector housing so as to allow the engagement protuberances of the cable retainer to be received therein in the engaged state when the cable retainer is inserted into the connector housing. In other words, when the cable retainer is inserted into the connector housing, the engagement protuberances of the cable retainer are brought in engagement with the engagement holes of the connector housing.

It is recommendable that each of the engagement protuberances of the cable retainer has certain resiliency or elasticity by forming slits, cutouts or the like at the positions located in the vicinity of the engagement protuberances on the opposite side walls of the cable retainer.

In addition, according to other aspect of the present invention, there is provided a connector including a plurality of slide housings each defined according to the preceding aspect of the present invention, wherein each of the slide housings is slidably received in a connector housing, and the slide housings are arranged one above another in the connector housing to provide a multi-stage connector.

With the connector constructed in the above-described manner, after a cable having a crimp terminal crimped thereon is drawn out of the connector housing, it is received in the cable receiving groove so that it is once bent by the cable receiving groove in the downward direction. Subsequently, the cable is squeezed by the cable retainer while it is received in the cable extension groove of the cable receiving portion, whereby the cable is twice bent by the cable retainer. Thus, the cable can reliably be held in the connector housing in the squeezed state without any possibility that it is disconnected from the connector housing and/or it is electrically incorrectly connected to the crimp terminal when a high intensity of pulling power is applied to the cable. Consequently, the physical properties of the connector in respect of shock resistance can substantially be improved.

Other objects, features and advantages of the present invention will become apparent from reading of the following description which has been made in conjunction of the accompanying drawings.

BRIEF DESCRIPTION OF THE DRAWINGS

The present invention is illustrated in the following drawings in which.

DESCRIPTION OF THE PREFERRED EMBODIMENT

The present invention will now be described in detail hereinafter with reference to FIG. 1 to FIG. 6 which illustrate a preferred embodiment thereof.

Figure 1:
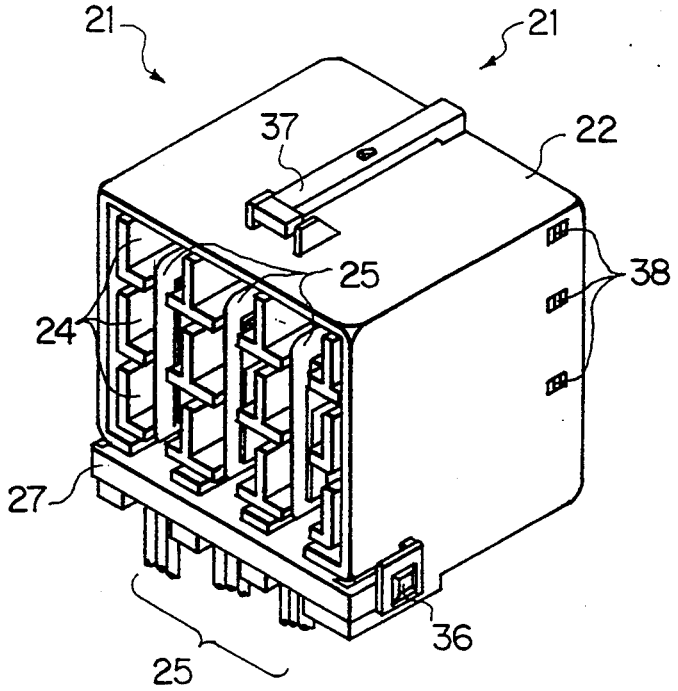
FIG. 1 is a perspective view of a connector constructed according to an embodiment of the present invention.
Figure 2:
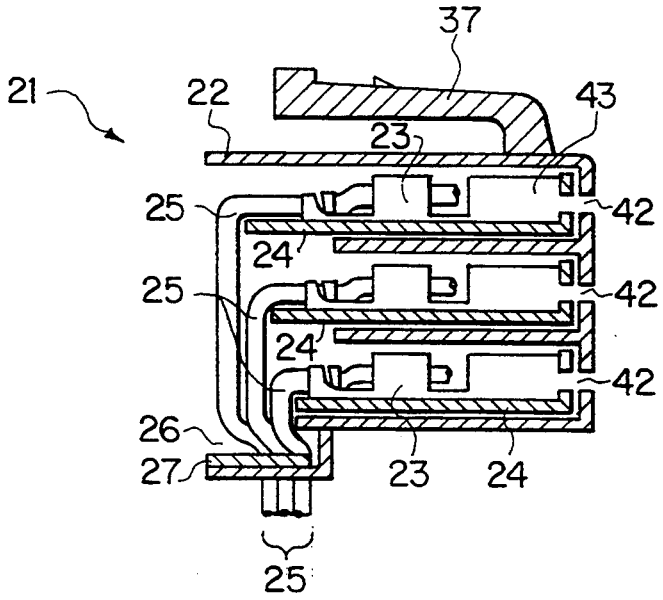
FIG. 2 is a vertical sectional view of the connector shown in FIG. 1, particularly showing the inner structure of the connector.
Figure 3:
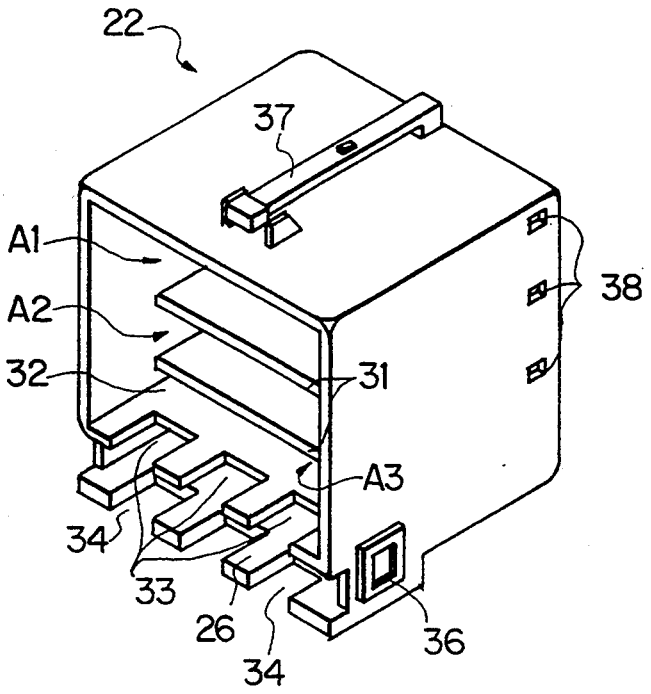
FIG. 3 is a perspective view of a connector housing for the connector.
Figure 4:
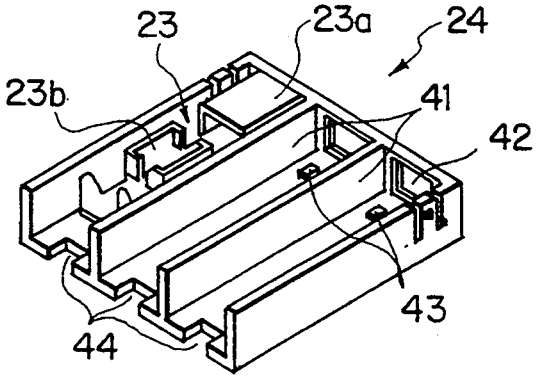
FIG. 4 is a perspective view of a slide housing for the connector.
Figure 5:
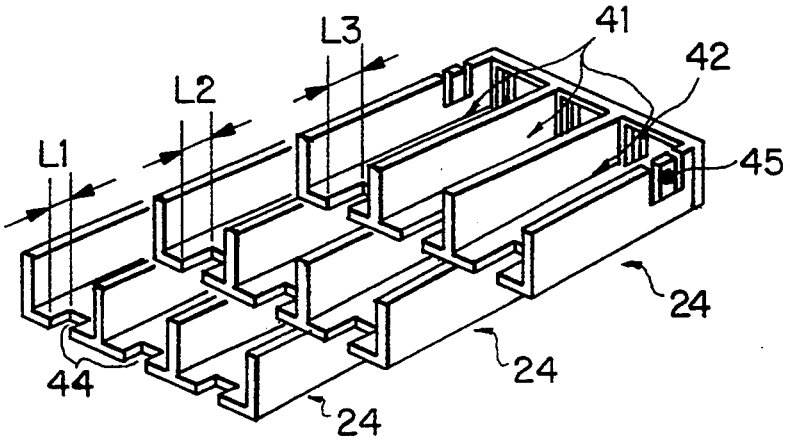
FIG. 5 is a perspective view of three slide housings for the connector each having dimensions different from those of the slide housing shown in FIG. 4.
Figure 6:
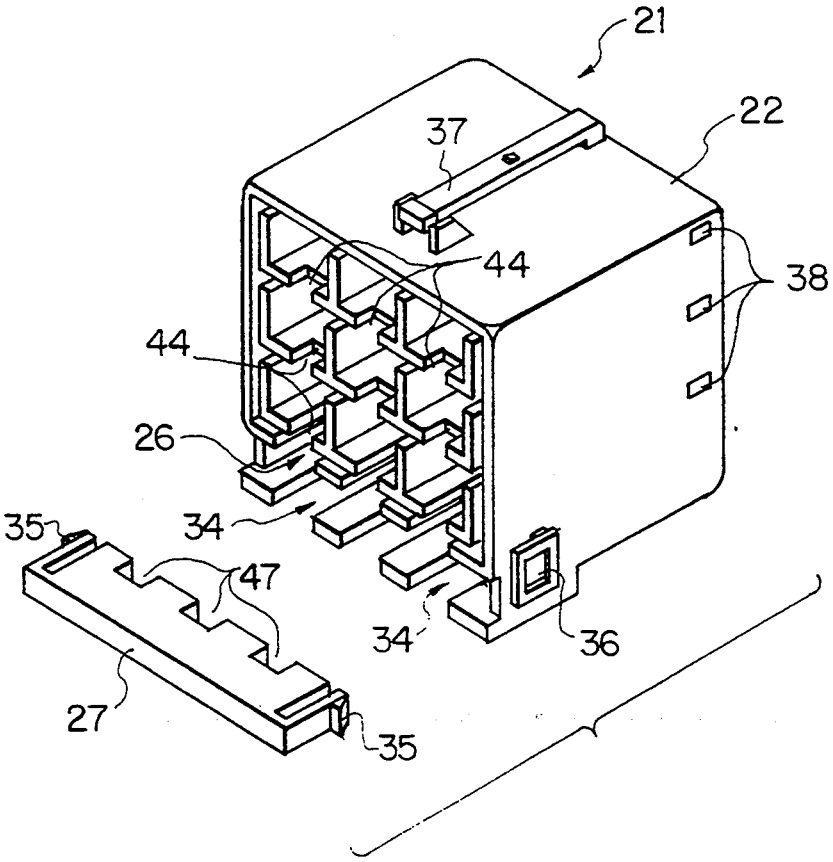
FIG. 6 is a perspective view of the connector, particularly showing the state before a cable retainer is inserted into the connector housing of the connector on a cable receiving portion.
Figure 7:
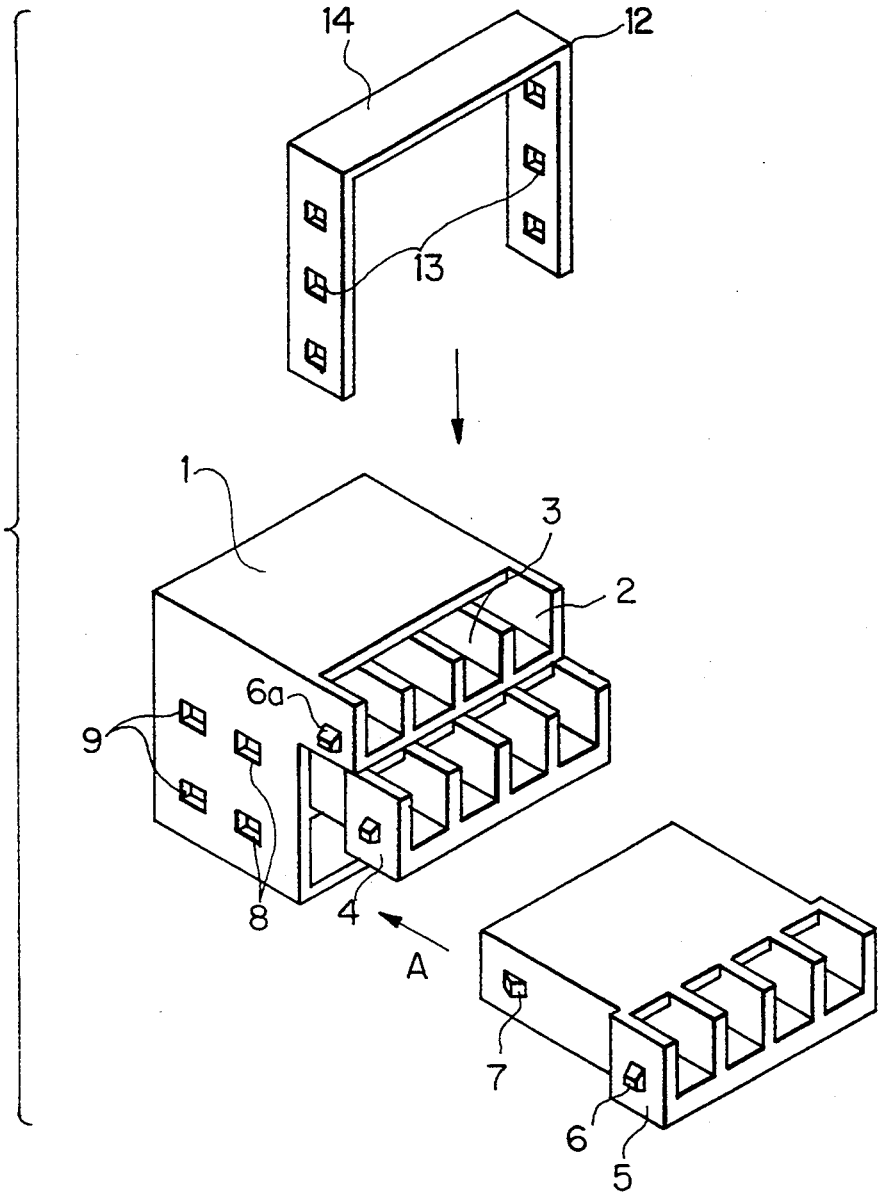
FIG. 7 PRIOR ART
FIG. 7 is a perspective view of a conventional multi-stage connector, particularly showing essential components constituting the conventional multi-stage connector.
Figure 8:
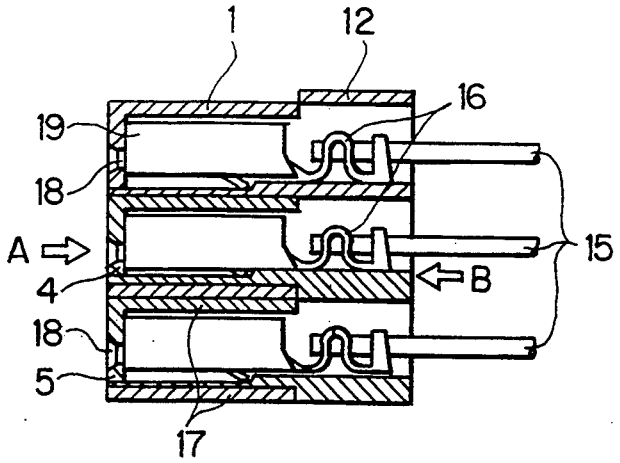
FIG. 8 PRIOR ART
FIG. 8 is a vertical sectional view of the conventional multi-stage connector shown in FIG. 7, particularly showing the inner structure of the conventional multi-stage connector.
Figure 9:
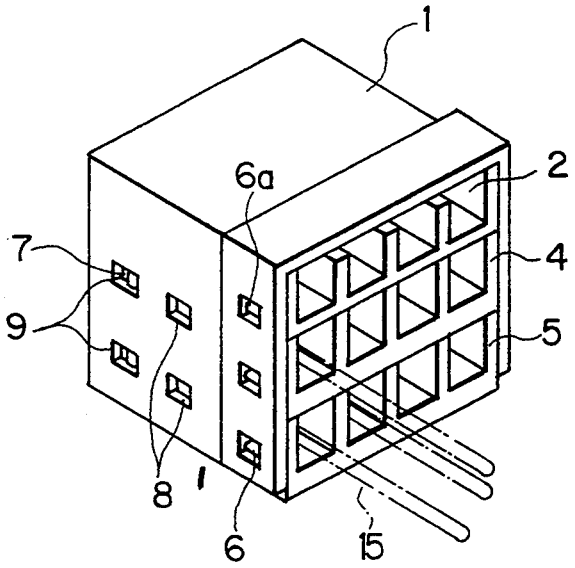
FIG. 9 PRIOR ART
FIG. 9 is a perspective view of the conventional multi-stage connector in the assembled state.

FIG. 1 is a perspective view of a multi-stage connector constructed according to the embodiment of the present invention, particularly showing the whole structure of the multi-stage connector, FIG. 2 is a vertical sectional view of the multi-stage connector shown in FIG. 1, FIG. 3 is a perspective view of a connector housing for the multi-stage connector, FIG. 4 is a perspective view of a slide housing for the multi-stage connector with a single crimp terminal received therein, FIG. 5 is a perspective view of three slide housing for the multi-stage connector, and FIG. 6 is a perspective view of the multi-stage connector, particularly showing the contour of a cable retainer to be inserted into a connector housing of the multi-stage connector.

The multi-stage connector generally designated by reference numeral 21 (hereinafter referred to simply as a connector) includes a connector housing 22 in which three slide housings 24 each having a plurality of crimp terminals 23 received therein are arranged one above another to assume a three-stage structure. In this embodiment, each cable 25 having a crimp terminal crimped thereon is drawn out of the connector housing 22 and extends in the vertical direction, i.e., in the downward direction, and a plurality of cables 25 are firmly retained in the squeezed state on a cable receiving portion 26 disposed along the bottom wall of the connector housing 22. A cable retainer 27 serves to retain the cables 25 on the cable receiving portion 26 without any possibility that the cables 25 are disconnected from the connector housing 22.

Next, each of components constituting the connector 21 will be described below.

As is best seen in FIG. 3, the interior of the connector housing 22 is divided into three stages with partition plates 31 interposed between adjacent stages in order to form three hollow spaces A1, A2 and A3 in each of which a slide housing 24 is slidably received in the superimposed state. The connector housing 22 includes a bottom plate 32 in which three cable receiving grooves 33 are formed at the fore end thereof, and the cable receiving portion 26 is disposed below the bottom plate 32.

Three cable extension grooves 34 are formed through the cable receiving portion 26 at the positions located directly below the cable receiving grooves 33 of the bottom plate 32, and engagement holes 36 are formed on the opposite side walls of the connector housing 22 so as to receive engagement projections 35 disposed at the opposite side walls of the cable retainer 27 therein in the engaged state when the cable retainer 27 is inserted into the connector housing 22. In addition, a handle 37 is disposed on the upper surface of the connector housing 22.

As shown in FIG. 4, three terminal receiving chambers 41 are formed in each slide housing 24 in the side-by-side relationship, and three insert holes 42 are formed through the rearmost end wall of the slide housing 24 so as to allow three male terminals (not shown) to be inserted into the terminal receiving chamber 41 through the insert holes 42. Each crimp terminal 23 is received in the corresponding terminal receiving chamber 41 in such a manner that a female terminal portion **23*a* of the crimp terminal 23 is communicated with the insert hole 42. Thus, a crimping portion 23*b* of the crimp terminal 23 is located on the fore end side of the terminal receiving chamber 41**.

The three slide housings 24 are designed to exhibit a same configuration with the exception that each of the cable extension grooves 44 has a different depth which varies among the three slide housings 24 corresponding to the upper stage, the middle stage and the lower stage.

Referring to FIG. 5, on the assumption that the cable receiving groove 44 of the slide housing 24 at the upper stage has a depth L1, the cable receiving groove 44 of the slide housing 24 at the middle stage has a depth L2, and the cable receiving groove 44 of the slide housing 24 at the lower stage has a depth L3, the relationship represented by an inequality of $L1<L2<L3$ is established among the three cable receiving grooves 44.

It should be noted that a difference appearing among the three depths L1, L2 and L3 may be determined depending on a diameter of the cable 25. For example, two cables 25 can extend through the cable receiving groove 44 having the depth L2, and three cables 25 can extend through the cable receiving groove 44 having the depth L3. Engagement protuberances 45 are formed on the opposite side walls of each slide housing 24 at the positions located on the end side of the same. Thus, when the slide housing 24 is inserted into the connector housing 22 to reach a predetermined position, the engagement protuberance 45 are engaged with the engagement holes 38 formed through the opposite side walls of the connector housing 22.

Next, the structure of the cable retainer 27 will be described below with reference to FIG. 6.

As shown in the drawing, the cable retainer 27 is basically constructed to exhibit a plate-shaped contour, and a thickness and a width of the cable retainer 27 are determined in such a manner as to enable it to be inserted into the connector housing 22 on the cable receiving portion 26. Three cable retaining grooves 47 are formed on the insert side of the cable retainer 27 to be inserted into the connector housing 22 while they are located in vertical alignment with the opponent cable extension grooves 34 of the cable receiving portion 26, whereby three cables 25 are firmly held in the squeezed state while they are reliably retained in the cable retaining grooves 47 of the cable retainer 27 in cooperation with the cable receiving portion 26. Engagement protuberances 35 are disposed on the opposite side walls of the cable retainer 27 while projecting outside of the same, and a certain magnitude of resiliency or elasticity is given to the engagement protuberances 35 by forming two slits, cutouts or the like at the position located in the vicinity of the opposite side walls of the cable retainer 27.

Next, an assembling operation to be performed for the connector 21 constructed in the aforementioned manner will be described below.

As shown in FIG. 4, first, crimp terminals 23 are received in the respective terminal receiving chambers 41 of the slide housings 24, and thereafter, each cable 25 is brought in contact with a crimping portions 23*b* of each crimp terminal 23 which in turn is crimped on the cable 25.

Subsequently, the three slide housings 24 are successively inserted into the hollow spaces A1, A2 and A3 in the connector housing 22. At this time, when the order of extension of the cables 25 is taken into account, it is desirable from the viewpoint of an operational efficiency that an inserting operation is executed from the lower stage of the connector housing 22, i.e., from the hollow space A3. Specifically, while the crimping portion 23*b* is crimped on each cable 25, the slide housing 24 including three cable receiving portions 44 each having a depth L3 is inserted into the hollow space A3, subsequently, the cables 25 drawn out of the fore end of the connector housing 22 are bent in the downward direction, and thereafter, they are caused to extend through the cable receiving grooves 33, the cable retaining grooves 47 and the cable extension grooves 34 in the downward direction.

Next, the slide housing 24 including three cable receiving portions 44 each having a depth L2 is inserted into the hollow space A2, subsequently, the cables 25 drawn out of the fore end of the connector housing 22 are bent in the downward direction, and thereafter, they are caused to extend in the downward direction in the same manner as mentioned above. Finally, the slide housing 24 having three cable receiving portions 44 each having a depth L1 is inserted into the hollow space A1, subsequently, the cables 25 drawn from the rear end of the connector housing 22 are bent in the downward direction, and thereafter, they are caused to extend in the downward direction in the entirely same manner as mentioned above.

On completion of the foregoing steps, nine cables 25 drawn out of the rear end of the connector housing 22 are caused to extend through the cable receiving grooves 44 of the slide housing 24, the cable receiving grooves 33 of the bottom plate 26 and the cable retaining grooves 47 of the cable retainer 27 so as to allow three cables 25 to separately extend through the cable receiving holes 44 of the slide housing 24, the cable retaining grooves 47 of the cable retainer 27 and the cable extension grooves 34 of the bottom plate 26. When the cable retainer 27 is inserted into the connector housing 22 on the cable receiving portion 26 while the foregoing state is maintained, three cables 25 are reliably received in the squeezed state in cooperation with the cable receiving portion 26, and thereafter, they are caused to extend past the cable receiving portion 26 in the downward direction. When the cable retainer 27 is inserted into the connector housing 22 to reach a predetermined position, the engagement protuberances 35 are fitted into the engagement holes 36 and this prevents the cable retainer 27 from being disconnected from the connector housing 22.

An advantageous effect of the connector constructed in the above-described manner is that the cables 25 bent downward of the rear end of each slide housing 24 are bent further toward the rear end of the cable receiving portion 26 by the function of the cable retainer 27, and moreover, they are restrainably retained by the cable retainer 27. As is apparent from FIG. 2, the cables 25 are twice bent and then reliably retained by the cable retainer 27. With such construction, there does not arise a malfunction that the crimped state of each cable is adversely affected by a high intensity of pulling power applied to a bundle of cables, because the foregoing pulling power is borne by the cable retainer 27 in cooperation with the cable receiving portion 26.

Another advantageous effect of the connector is that any shock is not imparted directly to the crimped part of each crimp terminal, and moreover, the physical properties of the connector in respect of shock resistance and an intensity of fixing power can be improved, resulting in the reliability of the connector being substantially improved.

Although the present invention has been described above with respect to the embodiment wherein the connector is designed in the form of a multi-stage connector, it should of course be understood that the present invention should not be limited only to this embodiment but various change or modification may be made without any departure from the scope of the present invention as defined by the appended claims. For example, the connector may includes a single slide housing, i.e., a single stage. Also in this case, the advantageous effects of the connector as mentioned above are unchangeably guaranteed as they are.

What is claimed is:

1. In a connector wherein a slide housing having a crimp terminal received therein is slidably received in a connector housing, said crimp terminal being crimped on a cable so as to be electrically connected to said crimp terminal, and said cable having said crimp terminal crimped thereon is drawn out of said slide housing, the improvement comprising;

a cable receiving groove formed at one end of said slide housing from which said cable is drawn out, a cable receiving portion disposed on the bottom wall of said connector housing in operative association with said cable receiving groove of said slide housing, a cable extension groove formed on said cable receiving portion at the position located in alignment with said cable receiving groove of said slide housing, and a cable retainer adapted to be inserted into said connector housing on said cable receiving portion, said cable retainer serving to firmly hold said cable drawn outside of said connector housing in the squeezed state in cooperation with said cable receiving groove of said slide housing and extending through said cable extension groove of said receiving portion in a predetermined direction.

2. The connector as claimed in claim 1, wherein said cable retainer is designed in the form of a substantially elongated plate.

3. The connector as claimed in claim 1, wherein a cable retaining groove is formed on said cable retainer at the position located in alignment with said cable receiving groove of said slide housing and said cable extension groove of said cable receiving portion.

4. The connector as claimed in claim 1, wherein engagement protuberances are disposed on the opposite side walls of said cable retainer while projecting outside of the same.

5. The connector as claimed in claim 4, wherein engagement holes are formed through the opposite side walls of said connector housing so as to allow said engagement protuberances of said cable retainer to be received therein in an engaged state when said cable retainer is inserted into said connector housing.

6. The connector as claimed in claim 4, wherein each of said engagement protuberances of said cable retainer has elasticity by forming slits at the positions located in the vicinity of said engagement protuberances.

7. In a connector including a plurality of slide housings each as claimed in claim 1, the improvement wherein;

each of said slide housings is slidably received in said connector housing, and said slide housings are arranged one on another in said connector housing to provide a multi-stage connector.

* * * * *